US012054997B2

(12) United States Patent
Armistead et al.

(10) Patent No.: US 12,054,997 B2
(45) Date of Patent: Aug. 6, 2024

(54) ROTATABLE MANDREL HANGER

(71) Applicant: VAULT PRESSURE CONTROL LLC, Houston, TX (US)

(72) Inventors: Jason Meyer Armistead, Houston, TX (US); Christopher Cole Humphrey, Houston, TX (US); Andrew Browne Helvenston, Houston, TX (US); Khang Van Nguyen, Tomball, TX (US)

(73) Assignee: Vault Pressure Control, LLC, Houston, TX (US)

( * ) Notice: Subject to any disclaimer, the term of this patent is extended or adjusted under 35 U.S.C. 154(b) by 0 days.

(21) Appl. No.: 17/460,750

(22) Filed: Aug. 30, 2021

(65) Prior Publication Data

US 2022/0127913 A1 Apr. 28, 2022

Related U.S. Application Data

(60) Provisional application No. 63/106,620, filed on Oct. 28, 2020.

(51) Int. Cl.

| | |
|---|---|
| ***E21B 17/07*** | (2006.01) |
| ***E21B 17/08*** | (2006.01) |
| ***E21B 23/00*** | (2006.01) |
| ***E21B 33/04*** | (2006.01) |

(52) U.S. Cl.

CPC ..... *E21B 17/07* (2013.01); *E21B 17/08* (2013.01); *E21B 23/00* (2013.01); *E21B 33/0415* (2013.01)

(58) Field of Classification Search

CPC ..... E21B 17/07; E21B 17/08; E21B 23/00; E21B 33/0415

See application file for complete search history.

(56) References Cited

U.S. PATENT DOCUMENTS 1,650,102 A * 11/1927 Tschappat ..... E21B 33/0422 285/123.6
2,011,769 A * 8/1935 Leman ..... E21B 33/03 285/402
2,694,450 A * 11/1954 Osbun ..... E21B 33/0415 166/75.14
3,528,686 A * 9/1970 Nelson ..... E21B 33/043 285/321
3,628,604 A * 12/1971 Childers ..... E21B 33/043 166/87.1
5,327,965 A * 7/1994 Stephen ..... E21B 33/04 166/182

(Continued)

FOREIGN PATENT DOCUMENTS

DE 371916 * 12/1988

*Primary Examiner* — Jonathan Malikasim

(74) *Attorney, Agent, or Firm* — Morgan, Lewis & Bockius LLP

(57) ABSTRACT

A casing rotation system permits rotation of a casing string through a telescoping ring that selectively engages a casing hanger. When the telescoping ring is in a first axial position, it engages the casing hanger such that rotational force is transmitted from a running tool to the casing string. When the telescoping ring moves to a second axial position, it disengages the casing hanger such that rotational force is no longer transmitted to the casing string. The casing rotation system may include an inward-biased locking ring disposed about the casing hanger and optionally a bearing surface that reduces friction on the hangar.

19 Claims, 13 Drawing Sheets

(56) References Cited

U.S. PATENT DOCUMENTS

| | | | | |
|---|---|---|---|---|
| 6,082,460 | A * | 7/2000 | June | E21B 33/04 166/368 |
| 7,063,157 | B2 * | 6/2006 | Bartlett | E21B 23/00 166/345 |
| 8,171,996 | B2 | 5/2012 | Jennings | |
| 8,528,650 | B1 | 9/2013 | Smith et al. | |
| 8,763,708 | B2 | 7/2014 | Travis et al. | |
| 9,458,690 | B2 * | 10/2016 | Moellendick | E21B 33/0415 |
| 9,506,329 | B2 | 11/2016 | Massey et al. | |
| 9,689,229 | B2 | 6/2017 | Hanson et al. | |
| 9,765,588 | B2 * | 9/2017 | Mansukh | E21B 33/04 |
| 10,113,383 | B2 | 10/2018 | Duong et al. | |
| 10,233,714 | B2 * | 3/2019 | Cheah | E21B 23/02 |
| 10,648,243 | B1 * | 5/2020 | Burrows | E21B 17/046 |
| 10,669,792 | B2 | 6/2020 | Nguyen | |
| 10,851,607 | B1 * | 12/2020 | Cavanagh | E21B 23/03 |
| 11,215,038 | B2 * | 1/2022 | Cotton | E21B 17/06 |
| 11,421,500 | B2 * | 8/2022 | Kinkaid | E21B 33/04 |
| 11,459,843 | B2 * | 10/2022 | Bartlett | E21B 33/04 |
| 2014/0311753 | A1 * | 10/2014 | Hanson | E21B 33/14 166/208 |
| 2015/0041151 | A1 * | 2/2015 | Cocker, III | E21B 33/0415 166/380 |
| 2021/0017826 | A1 | 1/2021 | Nguyen | |

* cited by examiner

ROTATABLE MANDREL HANGER

BACKGROUND OF THE INVENTION

This disclosure relates in general to oil and gas tools, and in particular, to systems and methods for torqueable/rotatable hangers and casings.

In particular, embodiments of the present disclosure include a torqueable/rotatable solid mandrel hanger with an inward-biased lock ring and/or with a bearing that allows for rotation of the hangar at various operation times. Such arrangements may improve wellbore operations by incorporating the solid body mandrel hanger with the additional benefit of having the ability to rotate the hanger and thereby entire casing string to ease running of casing into wellbore, especially into lateral sections of wellbore.

DESCRIPTION OF PRIOR ART

In exploration and production of formation minerals, such as oil and gas, wellbores may be drilled into an underground formation. The wellbores may be cased wellbores where a casing or tubular string is positioned against a wall of the borehole, where cement may be injected to secure the casing string to the formation. A casing string is typically supported at its upper end by a casing hanger, which is located (or landed) within a wellhead at the surface. It may be desirable to rotate or torque a casing string, which is often done by applying rotational force to the casing hanger to which the casing string is attached.

An operator may desire to rotate a casing string in order to facilitate uniform dispersion of the cement used to secure the casing string. For example, void spaces or "bubbles" may form when the cement is injected, and such imperfections can be eliminated through rotation of the casing. However, if the casing string is rotated by frequently applying rotational force to the casing hanger, a simple threaded connection used to transmit that rotational force might become exceedingly difficult to disengage. Accordingly, there is a need in the industry for a tool that will allow rotational force to be transmitted to the casing hanger but will still allow the casing hanger to be easily disengaged from the tool, for example once the casing has been cemented in place.

One prior attempt to solve this need within the industry is the rotating mandrel casing hanger disclosed in U.S. Pat. No. 9,689,229. That design, however, includes numerous drawbacks, including the use of an outward biased lock ring, which carries substantial operational risks.

Because lock rings may be configured to carefully align with mating grooves, washing of the bowl may be necessary to dislodge debris that can contaminate a lock ring groove. However, with an inward biased lock ring of the present disclosure, once the energizing ring is fully lowered, it can be assured the lock ring is locked with full bearing area in contact. A pull test may be used after locking to confirm the lock ring (either an inward or outward biased lock ring) is in the groove. One problem with existing systems it that an outward biased lock ring may pass the pull test with only partial bearing area in contact from debris in groove. The lock ring may also pass the pull test with the outward biased lock ring also off its axis and pushed to a side in the event debris concentrations permit such movement as the lock ring springs out. This increases risk of failure.

Embodiments may also address plastic deformation issues associated with existing systems. Outward biased lock rings are more sensitive to plastic deformation that can lead to lock ring failure, if there is no ring that forces the outward biased lock ring to stay in the locked position. The hoop strength of the C-shaped ring is relied up to remain sprung out and locked. In contrast, with an inward biased lock ring, plastic deformation is less of a concern as the potential deformation does not lead to a loss of bearing area, and therefore possible equipment ejection. Accordingly, there may be a reduced risk with the inward biased lock ring, which may be checked after installation to determine whether the lock ring constricts sufficiently after pulling the energizing ring that secures the lock ring upward.

Furthermore, embodiments of the present disclosure may overcome existing systems that include annular flutes for flow and lack annular seals, thereby utilizing a separate packoff mechanism to seal annular spaces and to lock the hanger/packoff assembly down for pressure containment, where the separate packoff may include combinations of inward and outward biased lock rings, which may increase costs, complexity, and still face the operational issues associated with the outward biased lock rings. Examples of such designs are disclosed in U.S. Pat. No. 9,869,229, which describes numerous embodiments of rotating mandrel hangers with "flow-by ports" or "flow-by channels."

In this way, various embodiments may also improve safety associated with casing running systems. For example, embodiments of the present disclosure may expedite the pressure containment of the well after running the casing string. Operations consist of running the casing string, which can involve rotating the casing string using the torquing feature, to get around bends and into laterals, land the hanger on the shoulder and then quickly and/or without significant delay lock the lock ring into place. The time needed to remove a hanger running tool and install a separate sealing and locking packoff utilized with existing systems is avoided, improving safety and operations.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
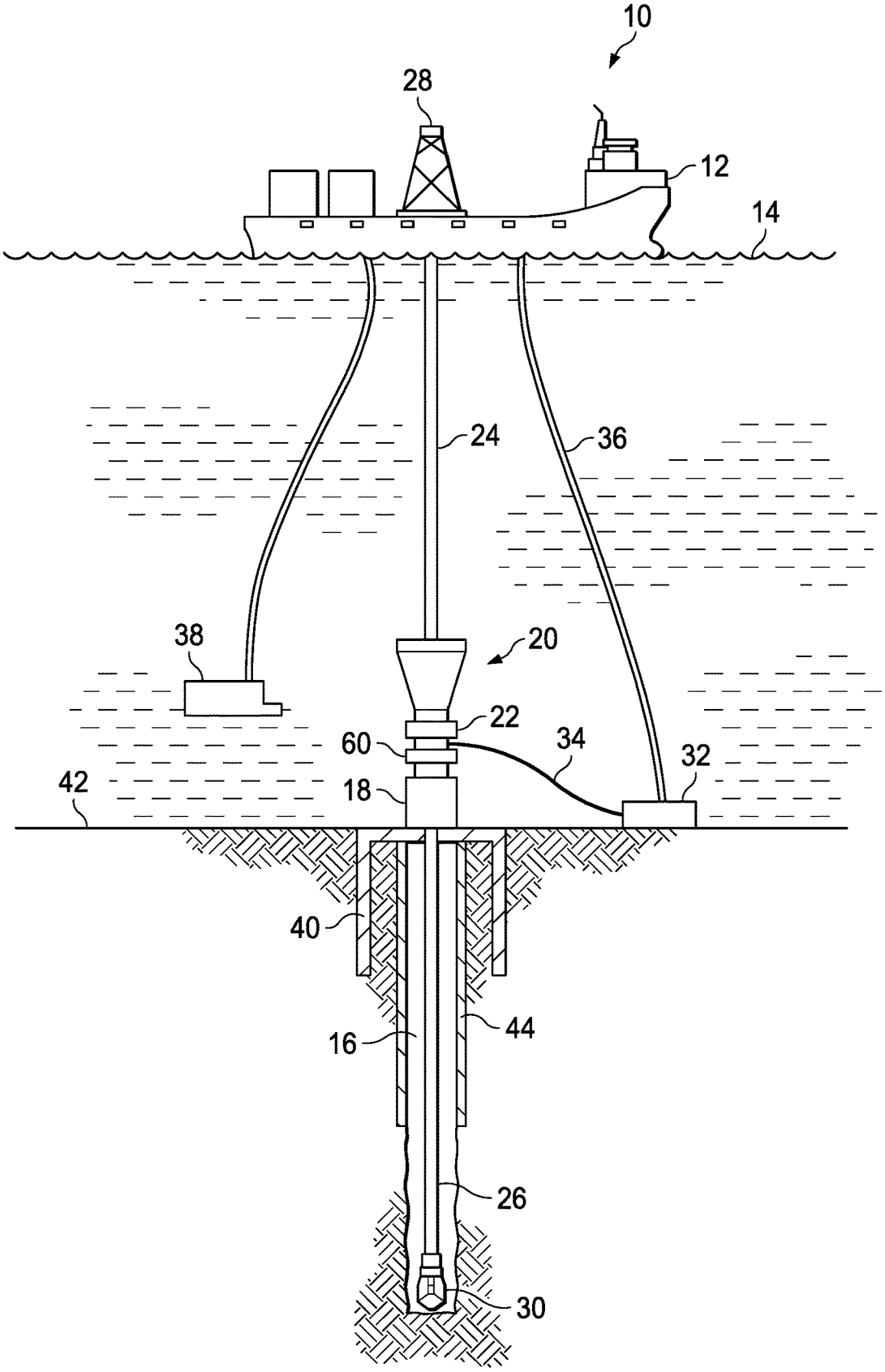
FIG. 1 is a schematic side view of an embodiment of a subsea drilling operation, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Various embodiments of the present disclosure utilize a solid-body mandrel hanger with features to facilitate transmission of torque to a casing string. By way of example, the hanger's top and bottom face may include torque transfer components, which may be milled or otherwise incorporated into the hanger. In certain embodiments, the milling may be referred to as a series of lugs and/or be referred to as castellated. Embodiments may also include one or more telescoping rings that move in and out of contact with the lugs and/or the casing. For example, a first portion of the telescoping rings may engage the lugs while an opposites second portion engages torque transfer features of the casing.

In various embodiments, a top of an upper ring interfaces with a base of a tool via the castellated interface. This top ring is bolted to the casing hanger running tool. The base of this upper ring is castellated and transfers torque via another castellated interface with lower ring when the lower ring is in its lowermost position. In certain embodiments, a bottom of the lower ring interfaces with the top of the hanger via asymmetrically ramped notches in the counterclockwise-facing direction, but it should be appreciated that alternative systems may utilize a clockwise-facing direction and that, in various embodiments described herein, thread directions may be either clockwise or counterclockwise based on design conditions. The opposing faces of each notch remains castellated in the clockwise direction for torque transfer in the clockwise direction. The top of the lower ring is castellated and transfers torque via the aforementioned castellated interface between upper and lower rings when the lower ring is in its lowermost position. After the torquing/rotating of the casing string and hanger is complete, the tool is rotated counterclockwise a predetermined amount (such as 30 degrees) to raise the lower ring via the ramped interface between hanger and lower ring of torque tool. Thereafter, a mechanism, such as spring-loaded pins, maintains the lower ring in an elevated position relative to the hanger such that further clockwise rotation of the tool is possible without engaging the torque function of the tool. This in turn permits the tool to lower toward the hanger body and lock the existing lock ring mechanism.

Embodiments of the present disclosure incorporate advantageous features of a solid hanger, inward biased lock ring, and casing rotation into a single system. Accordingly, systems of the present disclosure enable quick pressure containment of the well via the solid mandrel hanger. Moreover, systems also incorporate the inward biased lock ring to confidently lock the lock ring into its groove in the hanger's housing. Additionally, embodiments further permit rotation of the casing string via a tool/hanger design that transfers high torque from tool to hanger.

FIG. 1 is a schematic side view of an embodiment of a subsea drilling operation 10. The drilling operation includes a vessel 12 floating on the sea surface 14 (e.g., a surface location) substantially above a wellbore 16. It should be appreciated that a subsea well is shown for illustrative purposes only and that various embodiments of the present disclosure may also be utilized with surface wells. A wellhead housing 18 sits at the top of the wellbore 16 and is connected to a blowout preventer (BOP) assembly 20. In the illustrated embodiment, the BOP assembly 20 is arranged above a Christmas tree (XT) 22 (e.g., production tree). The XT 22 may include valves, spools, fittings, instrumentation, and the like. The BOP assembly 20 is connected to the vessel 12 by a drilling riser 24. During drilling operations, a drill string 26 passes from a rig 28 on the vessel 12, through the riser 24, through the BOP assembly 20, through the wellhead housing 18, and into the wellbore 16. At the lower end of the drill string 26 is attached a drill bit 30 that extends the wellbore 16 as the drill string 26 turns. Additional features shown in FIG. 1 include a mud pump 32 with mud lines 34 connecting the mud pump 32 to the BOP assembly 20, and a mud return line 36 connecting the mud pump 32 to the vessel 12. A remotely operated vehicle (ROV) 38 can be used to make adjustments to, repair, or replace equipment as necessary. Although a BOP assembly 20 is shown in the figures, the XT 22 could be attached to other well equipment as well, including, for example, a spool, a manifold, or another valve or completion assembly.

One efficient way to start drilling the wellbore 16 is through use of a suction pile 40. Such a procedure is accomplished by attaching the wellhead housing 18 to the top of the suction pile 40 and lowering the suction pile 40 to a sea floor 42. As interior chambers in the suction pile 40 are evacuated, the suction pile 40 is driven into the sea floor 42, as shown in FIG. 1, until the suction pile 40 is substantially submerged in the sea floor 42 and the wellhead housing 18 is positioned at the sea floor 42 so that further drilling can commence. As the wellbore 16 is drilled, the walls of the wellbore are reinforced with casings and concrete 44 to provide stability to the wellbore 16 and help to control pressure from the formation. It should be appreciated that while embodiments of the present disclosure are described with reference to subsea operations, embodiments of the present disclosure may be utilized with surface drilling operations.

Figure 2A:
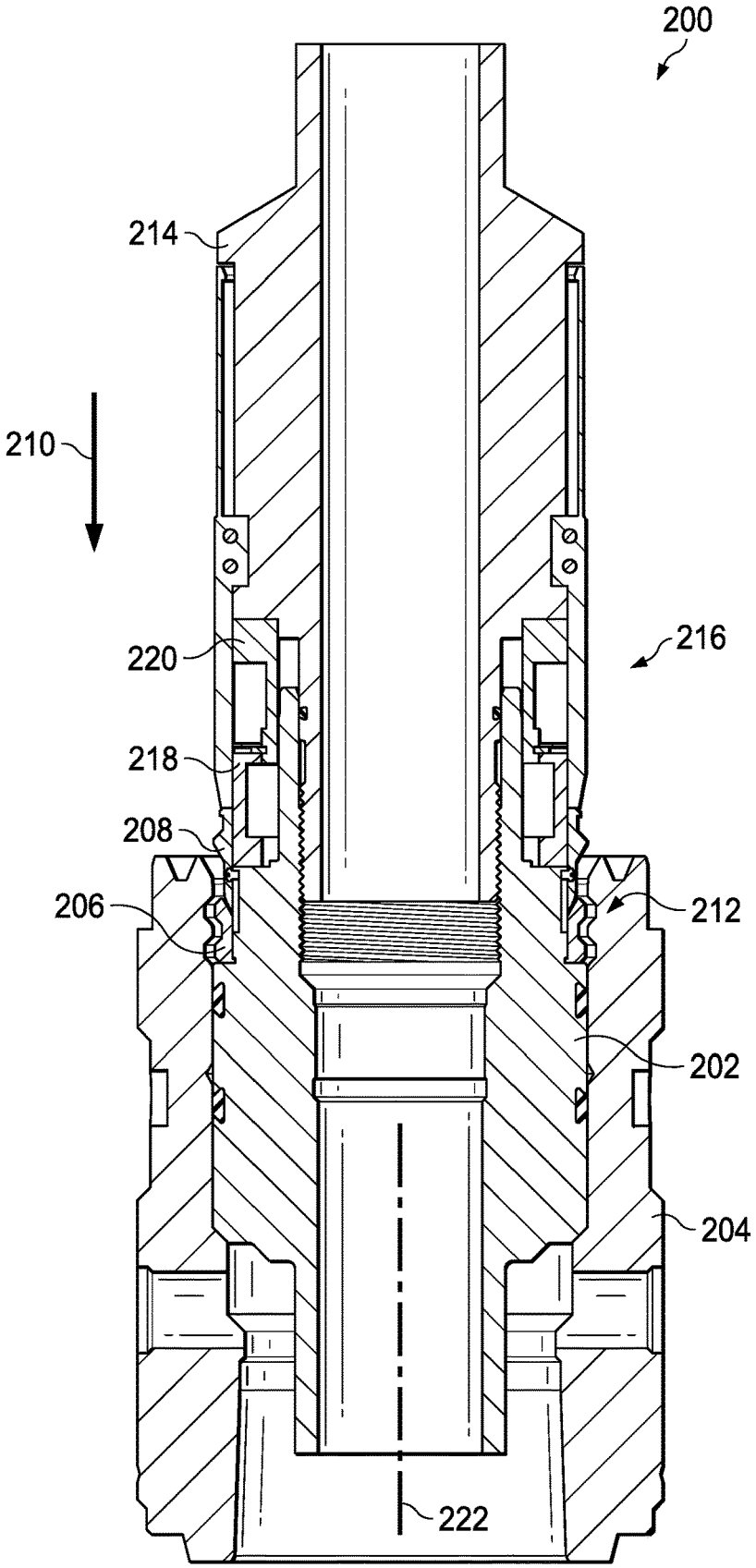
FIG. 2*a* is a cross-sectional view of an embodiment of a casing rotation system, in accordance with embodiments of the present disclosure.

FIG. 2*a* is a cross-sectional side view of an embodiment of a casing rotation system 200 that may be used with one or more embodiments of the present disclosure. In this example, a casing hanger 202 is positioned within a wellhead 204. The casing hanger 202 may be secured to the wellhead 204 via activation of a lock ring 206, which in this example may be a "C-shaped" lock ring that is inwardly biased. By way of example, the lock ring 206 may be substantially annular and include a cut or split to prevent a full circular formation. The lock ring might also be fully circular but with many spaced cuts forming a collet shape. The lock ring 206 may be inwardly biased in that the ends are driven together (as opposed to apart), thereby pressing against the casing hanger 202. For example, the c-shaped lock ring may be opened up slightly when installing on the hanger assembly, but embodiments may not have a seal along the contact between the lock ring and hanger. Accordingly, the c-shaped lock ring may be said to "press" or "bear against" or "engage" the hanger. An energizing ring 208 may be driven in an axially downward direction 210 to engage the lock ring 206 and drive the lock ring 206 into contact with grooves 212 of the wellhead 204. As will be described, there may be vertical contact between the energizing ring 208 and the lock ring 206, which provides a positive lock to prevent disengagement of the energizing ring 208.

In the example shown in FIG. 2*a*, the energizing ring 208 and/or the lock ring 206 may initially be in a disengaged or deactivated position such that axial movement of the casing hanger 202 is permitted within the wellhead 204. For example, a running tool 214 may be engaged with the casing hanger 202, for example via threads or another mechanism, to drive movement of the casing hanger 202 responsive to an uphole force. In this example, the running tool 214 is coupled to a torque transfer assembly 216, which includes a telescoping ring 218 (e.g., torque ring, torque transfer ring, ring, etc.) and a transfer sub 220. The transfer sub 220 in the illustrated embodiment is coupled to the running tool 214, for example via fasteners, threads, or the like. As will be described below, the transfer sub 220 may include lugs that engage mating lugs of the running tool 214 to transmit torque to the casing hanger 202.

The illustrated telescoping ring 218 is positioned axially lower than the transfer sub 220 in the illustrated embodiment, but it should be appreciated that in operation the telescoping ring 218 may translate along an axis 222. That is, the telescoping ring 218 may engage the casing hanger 202 in a first position and then move such that the telescoping ring 218 does not engage the casing hanger 202 in a second position. In various embodiments that will be described below, the telescoping ring 218 may include a series of torque transfer features that engage mating transfer features of the transfer sub 220 in the first position and disengage the mating transfer features in the second position. Furthermore, in various embodiments, the torque transfer features may engage mating features of the casing hanger 202 in the first position and disengage the casing hanger 202 in the second position while maintaining contact with the transfer sub 220 in the second position.

Figure 2B:
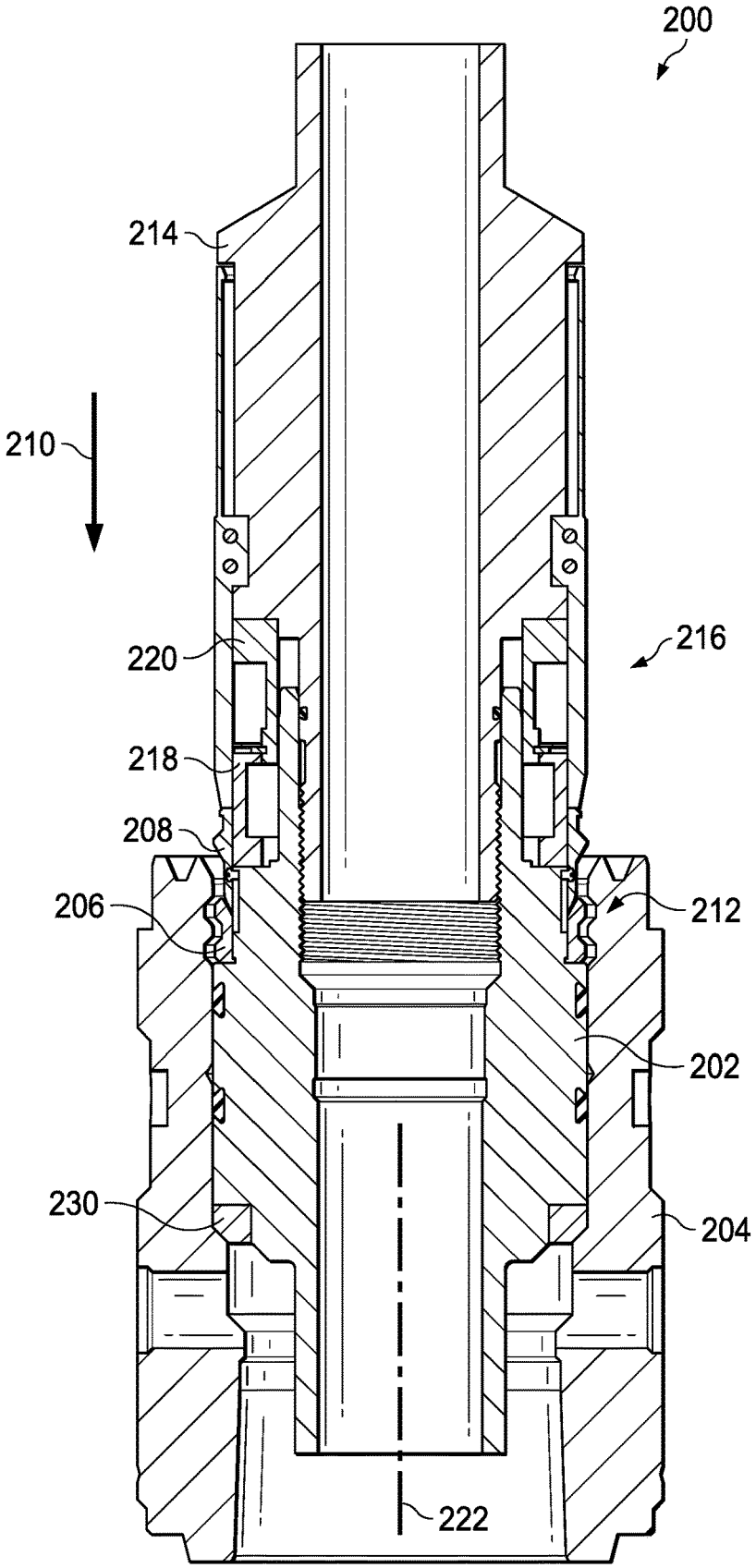
FIG. 2*b* is a cross-sectional view of an embodiment of a casing rotation system, in accordance with embodiments of the present disclosure.

FIG. 2*b* is a cross-sectional view of another embodiment of the present invention. In this embodiment of the current invention, a bearing 230 is situated above the lower portion of the hangar 202 where it is situated on the shoulder of the well casing 204. The bearing 230 allows the hangar 202 to rotate while axially locked in position without the use of additional tools or lock ring mechanisms. In this particular embodiment, the hangar 202 may be locked into place for additional operations without disengaging the hangar 202 and the transfer sub 220. This may be performed by the use of any friction decreasing member or surface that would be known to one of skill. Allowing rotation while axially locked increases the ability of the operation to perform ongoing drilling activities without additional stoppages for rotational work on the casing string and any other aspects of the downhole load on the well casing 204.

Figure 2C:
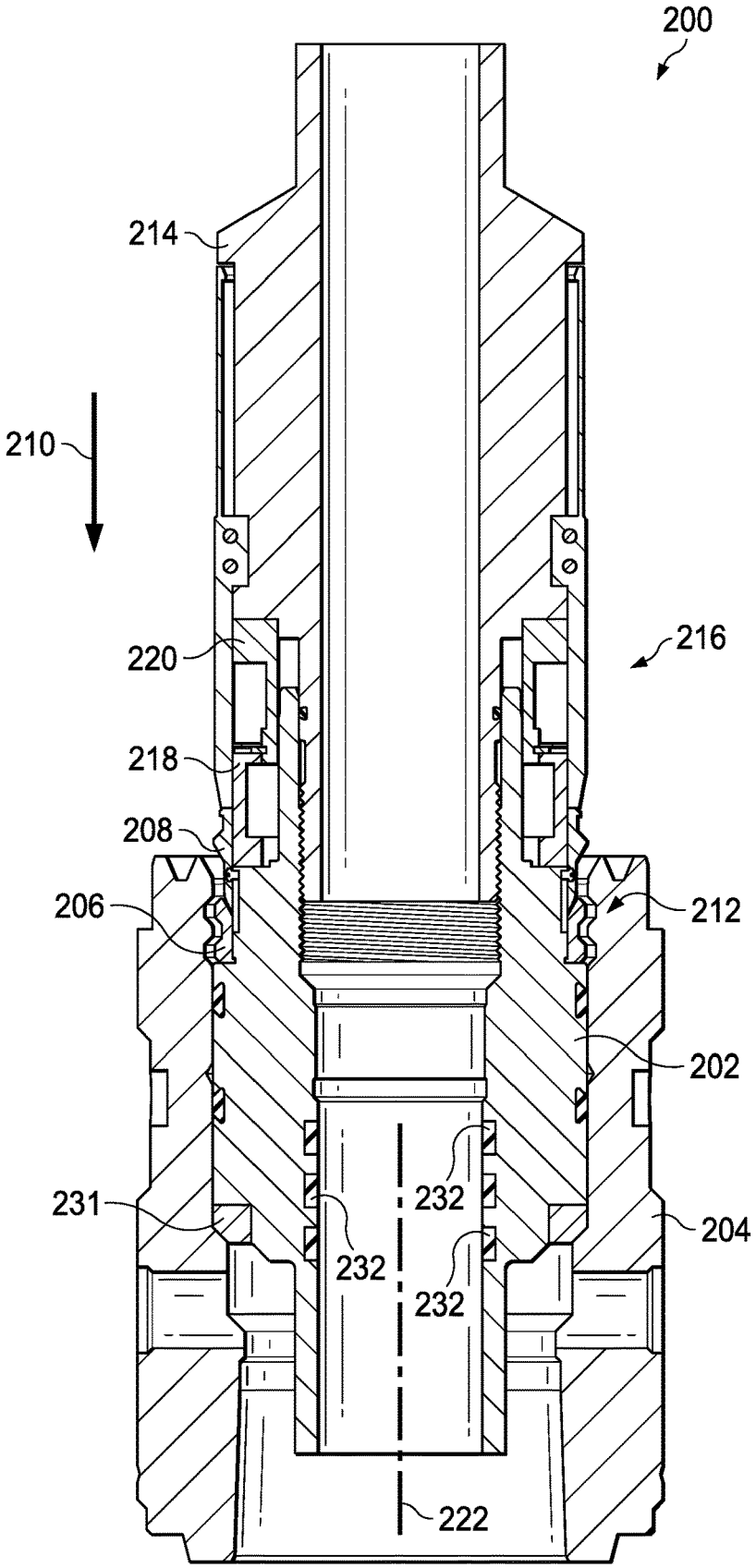
FIG. 2*c* is a cross-sectional view of an embodiment of a casing rotation system, in accordance with embodiments of the present disclosure.

Additionally, the FIG. 2*c* is a cross-sectional view of an embodiment of the present invention. In this embodiment, the surface between the hangar 202 is sealed by one or more dynamic seals to decrease the likelihood of well containment failure. The optional dynamic seals 232 may be singular or plural depending on the well requirements and pressures encountered. Seals of this type are known to one of skill in the art and could be of different materials as well as sizes depending on the operational requirements.

Figure 3:
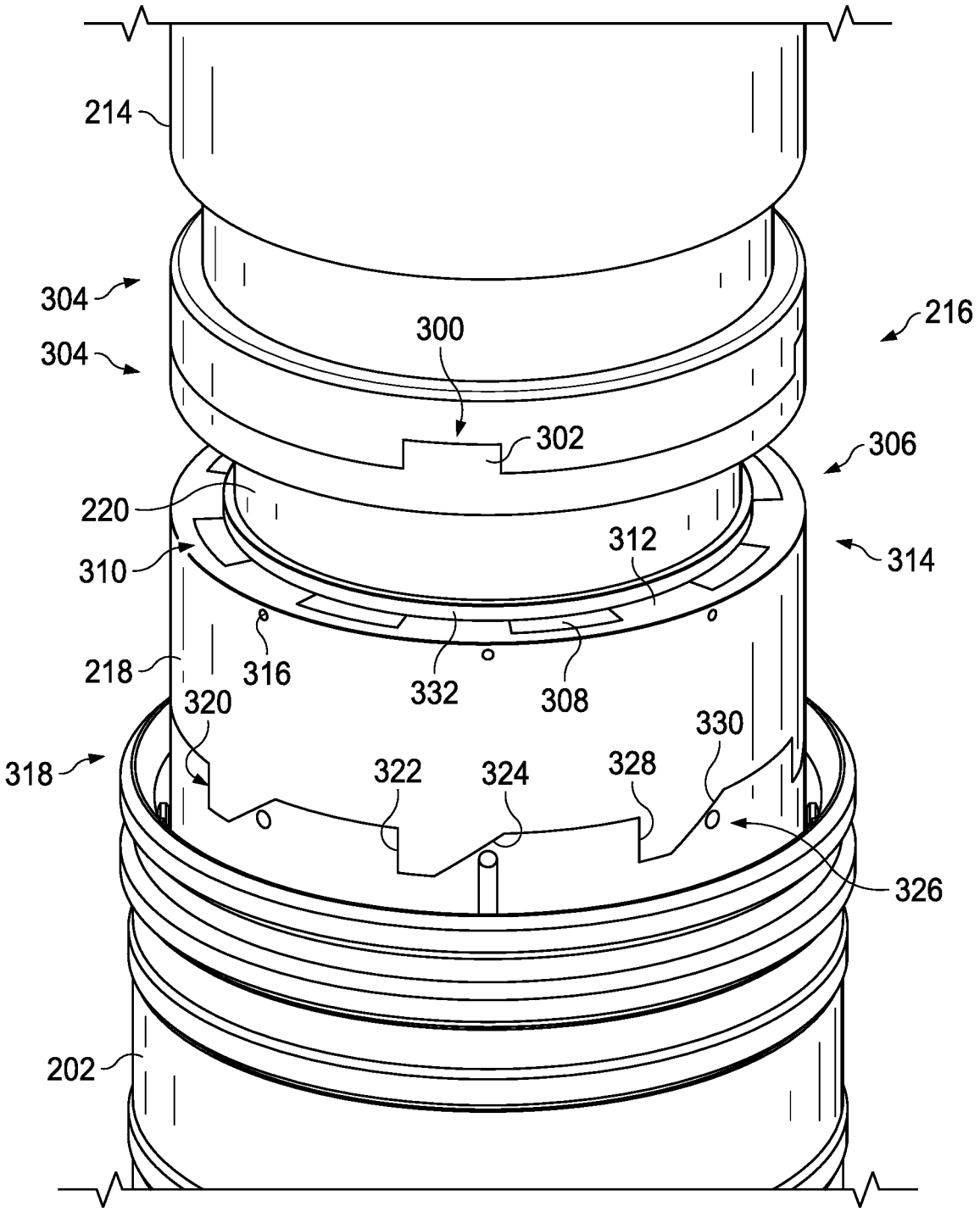
FIG. 3 is an isometric view of an embodiment of a torque transfer assembly, in accordance with embodiments of the present disclosure.

FIG. 3 is an isometric view of the torque transfer assembly 216. This example illustrates the system 200 where the running tool 214 is coupled to the transfer sub 220 arranged axially lower than the running tool 214. The telescoping ring 218 is illustrated engaged with a lower portion of the transfer sub 220 and also engaged with the casing hanger 202. It should be appreciated that certain features have been removed for clarity with the present disclosure, such as the energizing ring 208. Additionally, an outer sleeve for the running tool 214 (unnumbered item positioned radially outward from the running tool 214 in FIG. 2) is also omitted for clarify. It should be appreciated that various embodiments may incorporate one or more features of the outer sleeve to facilitate operation of the system, but various embodiments described herein may be separate from and/or disengaged from the outer sleeve.

The running tool 214 of the present embodiment includes tool recesses 300 that receive mating transfer features 302 of the transfer sub 220. The illustrated transfer features 302 are shown at an upper portion 304 of the transfer sub 220 and may also be referred to as upper transfer features 302. As shown in FIG. 3, upper transfer features 302 may comprise protrusions configured to mate with recesses 300. In this example, each of the recesses 300 and the features 302 are substantially rectangular, but it should be appreciated that other shapes may also be utilized. Furthermore, there may be more or fewer transfer features and/or recesses in other embodiments. In certain embodiments, additional fasteners and the like may also be utilized to secure the transfer sub 220 to the running tool 214, such as bolts, threads, clamps, and the like. Additionally, it should be appreciated that various components of the present embodiments may be integrally formed with one another. By way of example only, the transfer sub 220 may be integrally formed with the running tool 214. Additionally, features of the transfer sub 220 may be incorporated into the running tool 214, which may reduce costs and assembly simplicity.

Continuing with the transfer sub 220 of FIG. 3, a lower portion 306 includes a set of transfer lugs 308, which may also be referred to as lower transfer features. In this example, the lugs 308 may be referred to as castellated. The lugs 308 are positioned circumferentially about the axis 222 (not pictured) with adjacent lugs 308 being separated by spaces. The lugs 308 mate with openings 310 formed in the telescoping ring 218. In operation, torque is transmitted between the lugs 308 and mating ring lugs 312. The mating ring lugs 312 are shown at an upper portion of 314 of the telescoping ring 218. In this example, the lugs 308, 312 and openings 310 are substantially rectangular, but it should be appreciated that the components may be different shapes in other embodiments. Furthermore, the number of lugs 308, 312 and openings 310 may be particularly selected based on operating conditions. Furthermore, the relative size of the lugs 308, 312, and/or the openings 310 may also be adjusted based on operating conditions. For example, lugs 308, 312 may be larger if higher transfer forces are expected.

Further illustrated along the telescoping ring 218 are apertures 316 that may receive one or more pins or members to hold the telescoping ring 218 at a predetermined position. As will be described below, the ring 218 may be rotated and, in response to the rotation, may axially translate along the axis 222 (not pictured). At a predetermined position, a spring-loaded pin or a retention member may engage the apertures 316 to block further axial movement of the telescoping ring 318. It should be appreciated that the apertures 316 may be arranged at a different location along the telescoping ring 318 and that there may be more or fewer apertures 316.

The telescoping ring 218 further includes a lower portion 318 that has lower transfer features 320, which may also be referred to teeth, ramped teeth, or the like. In this example, the lower ring transfer features 320 are asymmetrical and include a ring planar end 322 and a ring sloped end 324. It should be appreciated that this configuration is for illustrative purposes only and that opposite ends may be either sloped or planar. Moreover, different configurations may be utilized to permit force transfer in one direction and restrict force transfer in an opposite direction. In this example, the lower ring transfer features 320 engage mating hanger transfer features 326, in this case in the form of a recessed portion that receives the ring transfer features 320, which include a mating hanger planar end 328 and a mating hanger sloped end 330. In this example, a clockwise rotation applied to the transfer ring 318 will be translated to the casing hanger 202 via contact between the ring planar end 322 and the hanger planar end 328. However, a counterclockwise rotation will lead to engagement between the ring sloped end 324 and the hanger sloped end 330, which will drive axially upward movement of the telescoping ring 218 as the sloped end 324 rides up the sloped end 330. In various embodiments, the rotation maybe approximately 30 degrees, however, it should be appreciated that different amounts of rotation may be particularly selected to move the planar ends 322, 328 out of engagement with one another. As the telescoping ring 318 continues to rotate in the counterclockwise direction, the upper ring portion 314 also moves axially upward, which may cause disengagement between the lugs 308, 312. In at least one embodiment, the apertures 316 and/or retention members positioned within the apertures 316 are engaged at a predetermined position, and as result, movement of the telescoping ring 218 may be restrained or otherwise restricted, which prevents further engagement between the lower ring transfer features 320 and the hanger transfer features 326. In one embodiment, a ridge 332 is illustrated on the transfer sub 220, which may receive a retention member to block downward movement of the telescoping ring 218.

Figure 4A:
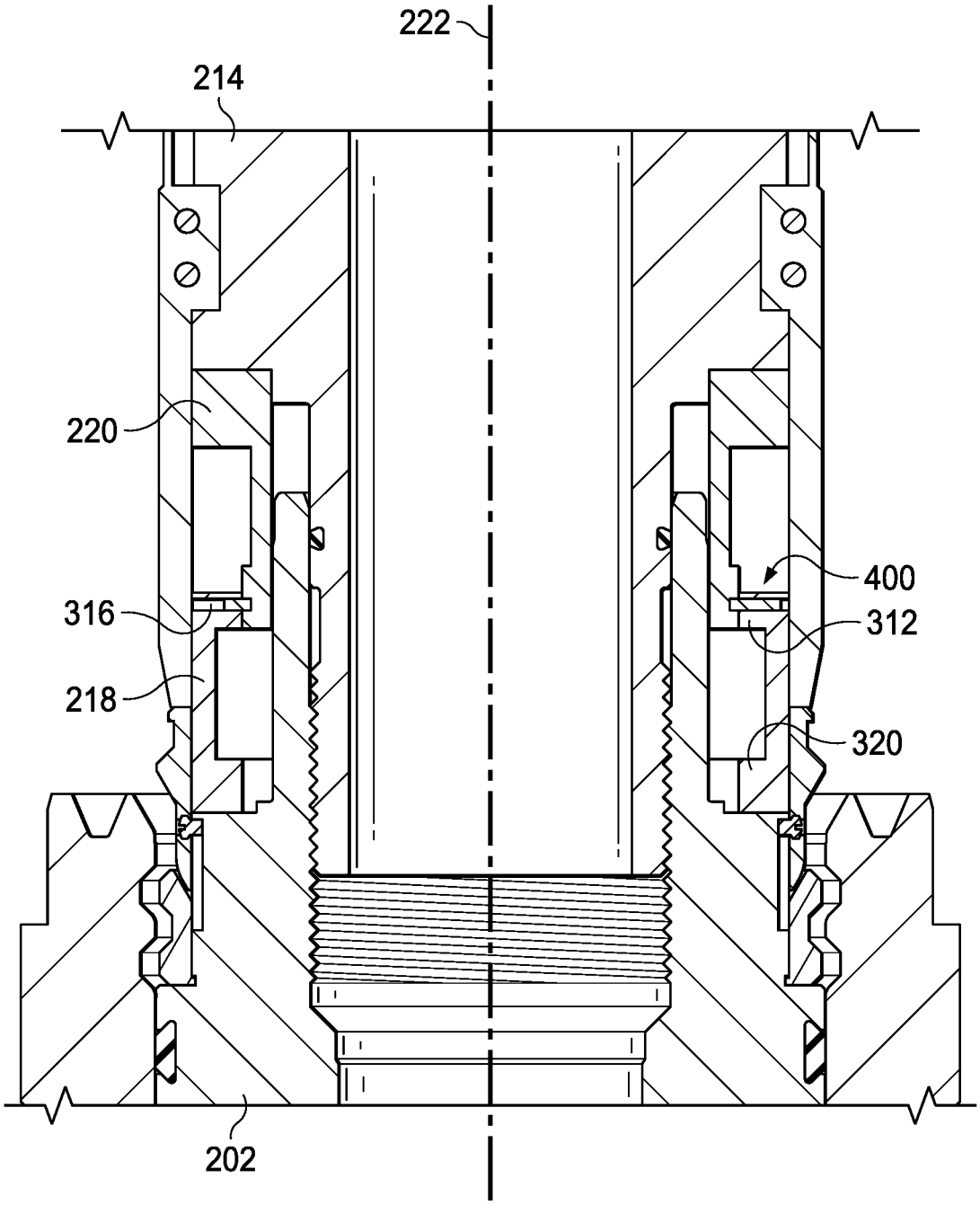
FIGS. 4A-4C are cross-sectional side views of embodiment of the casing rotation system moving between different active positions, in accordance with embodiments of the present disclosure.
Figure 4B:
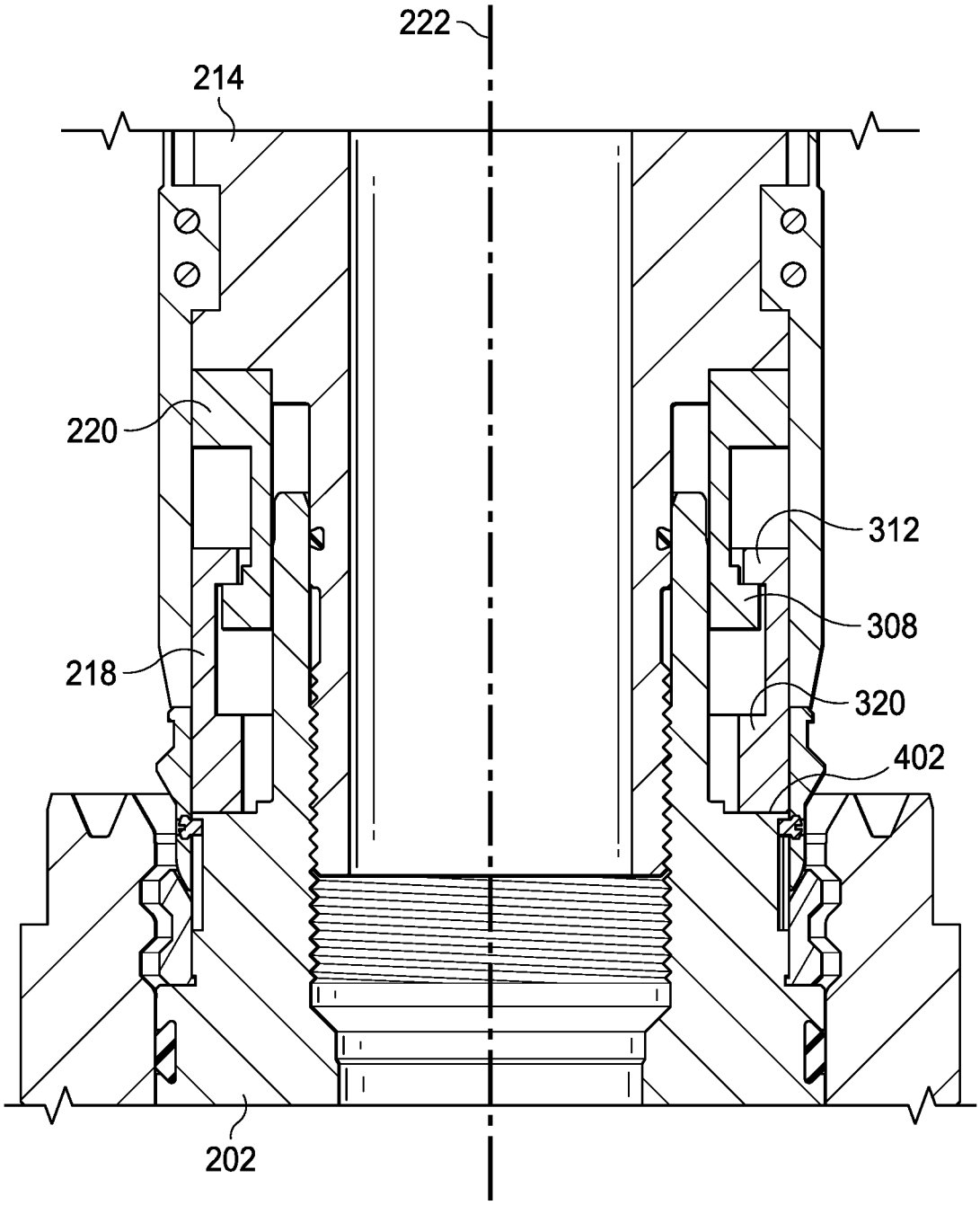
Figure 4C:
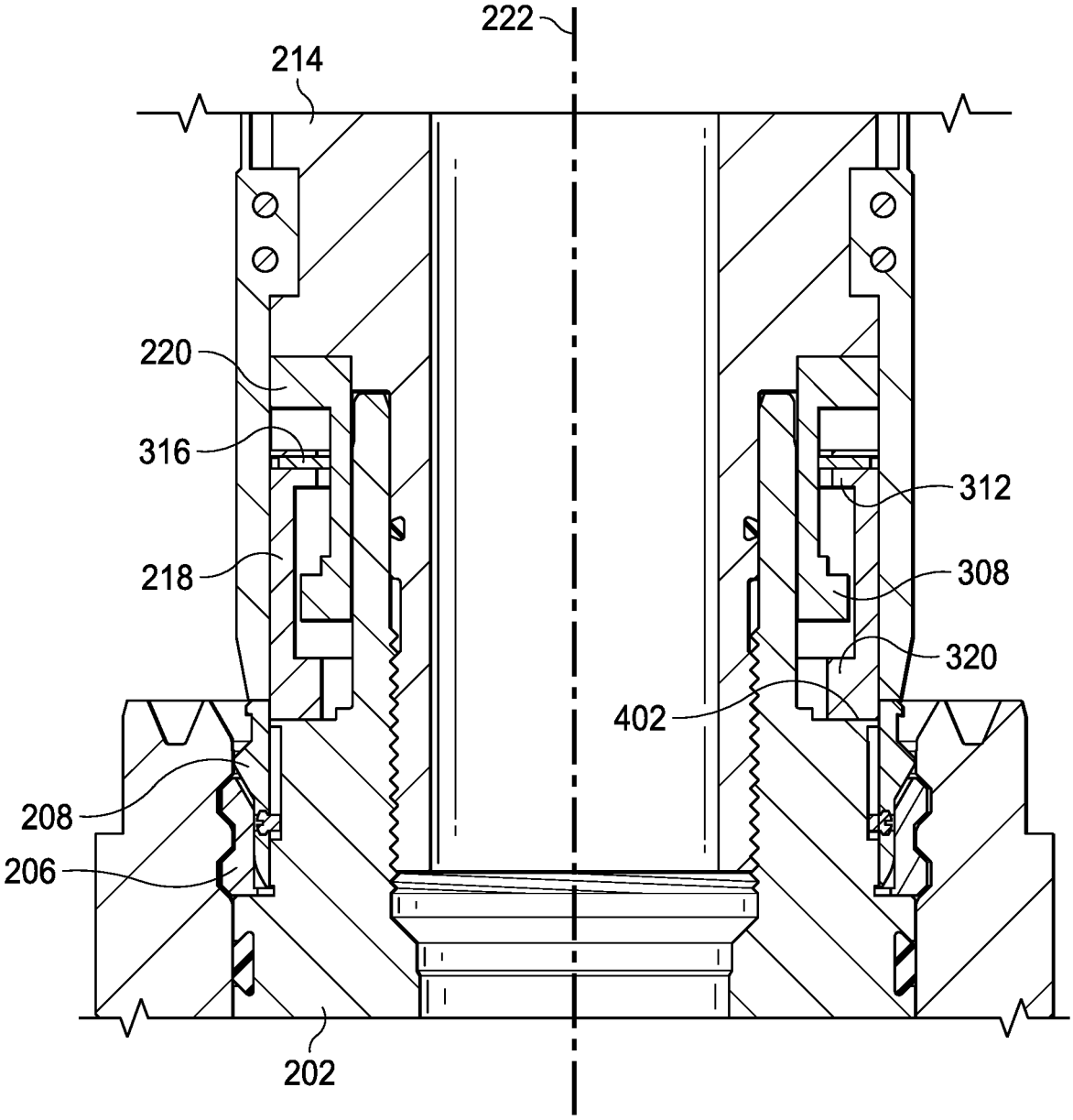

FIGS. 4A-4C are cross-sectional view of a series of steps for transmitting torque to the casing, disengaging the ring, and then setting the lock ring. It should be appreciated that various features have been removed for clarity and that certain features may be obscured due to the cross-sectional view. FIG. 4A illustrates engagement between the telescoping ring 218 and the casing hanger 202, for example via the respective transfer features 320, 326. Furthermore, engagement is illustrated between the lugs 308, 312. The running tool 214 may rotate, which transmits torque to the transfer sub 220 via the connection between the running tool 214 and the transfer sub 220. The lugs 308, 312 engage responsive to rotation of the transfer sub 220, which is transmitted to the telescoping ring 218 and then to the casing hanger 202 via the transfer features 320, 326.

In this example, the apertures 316 house retention members 400, which may be in the form of spring-loaded pins. As described above, the apertures 316 may be utilized to block axial movement of the telescoping ring 218 in at least one direction when the ring 218 reaches a predetermined location.

FIG. 4B illustrates disengagement of the telescoping ring 218 from the casing hanger 202. For example, rotation, such as counterclockwise rotation, may cause the sloped ends 324, 330 to engage, thereby driving upward axial movement of the telescoping ring 218. In this example, the lugs 308, 312 are disengaged from one another due to the upper axial movement of the telescoping ring 218. Furthermore, the lower ring transfer features 320 may ride up to sit on a shelf 402 of the casing hanger 202, which moves the lower ring transfer features 320 out of engagement with the hanger transfer features 326. In this position, further rotation of the running tool 212 may not be transmitted to the telescoping ring 218 due to the disengagement between the transfer sub 220 and the telescoping ring 218.

FIG. 4C illustrates the lock ring 206 set by the energizing ring 208. In this example, the energizing ring 208 has transitioned along the axis 222 and is now arranged radially between the lock ring 206 and the casing hanger 202, which drives the lock ring 206 into the grooves 212. As noted above, this provides a vertical contact with the lock ring 206 and the energizing ring 208, which may lead to a positive lock and reduce the likelihood of inadvertent movement or removal of the lock ring 206.

Further illustrated are the retention members 400 within the apertures 316. In various embodiments, the retention members 400 may engage holes in the transfer sub 220 and/or a shelf or ridge along the transfer sub 220 to block downward axial movement of the telescoping ring 218 after it has transitioned beyond a predetermined point. For example, counterclockwise rotation to drive the telescoping ring 218 out of contact with the casing hanger 202 may be performed as a final or near final step because further engagement between the telescoping ring 218 and the casing hanger 202 may be blocked after the counterclockwise rotation. In other words, once the telescoping ring 218 is set out of engagement with the casing hanger 202, further rotation of the running tool 214 is not transferred to the casing hanger 202.

Figure 5:
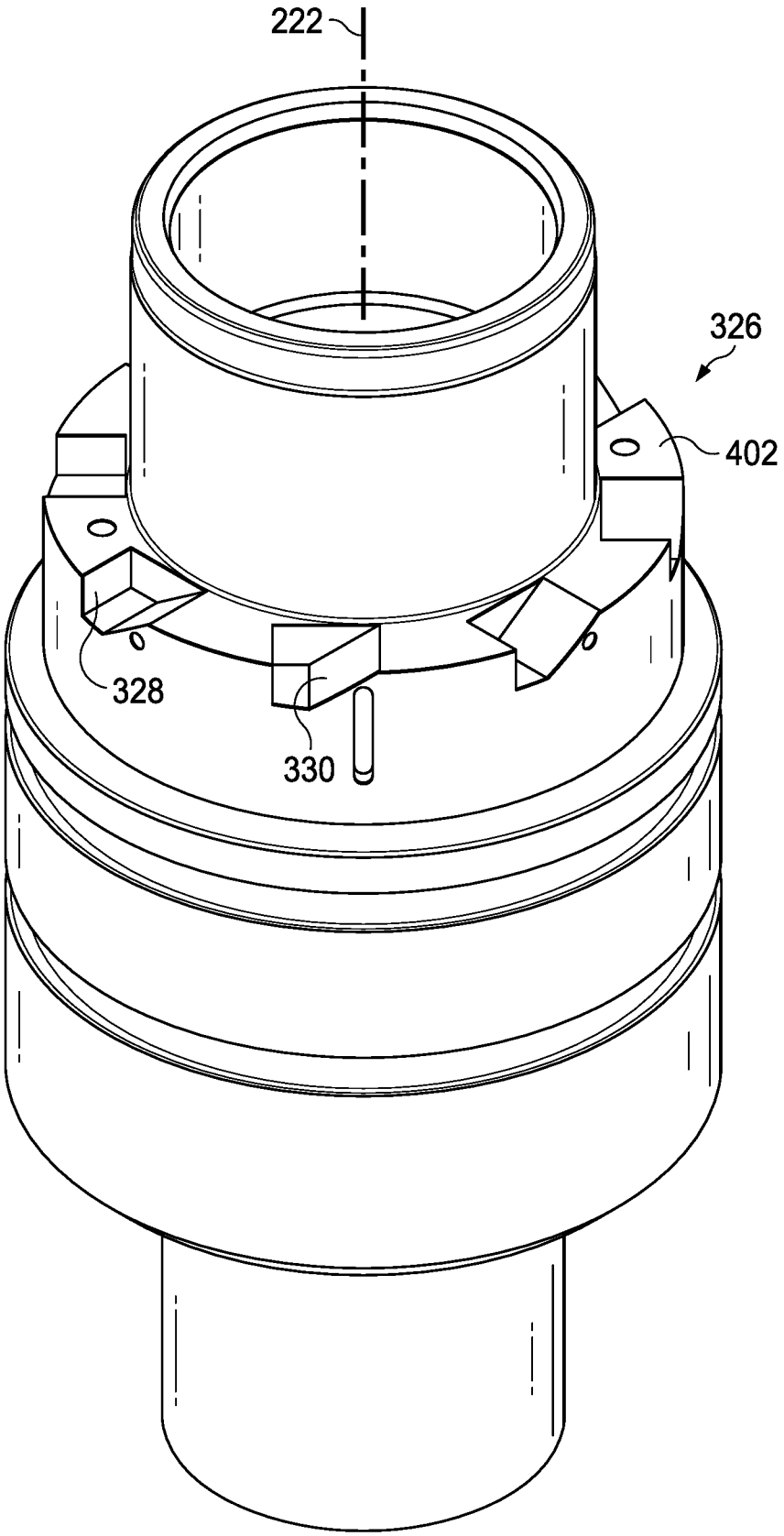
FIG. 5 is an isometric view of an embodiment of a casing hanger, in accordance with embodiments of the present disclosure.

FIG. 5 is an isometric view of an embodiment of the casing hanger 202 further illustrating the hanger transfer features 326. In this example, the transfer features 326 correspond to a series of grooves or cutouts that are arranged circumferentially about the axis 222. As noted above, various components or dimensions of the features 326 may be particularly selected based on expected operating conditions, such as a depth, a length, a width, and/or an angle of the sloped end 330. In this example, the planar end 328 is separated from the sloped end 330 by an opening or void, which may receive the mating lower ring transfer features 320, as described above. Further illustrated is the shelf 402, which may be considered a region axially higher than the cutouts for the features 326, which may receive and support the features 320 when they are disengaged from the casing hanger 202.

Figure 6:
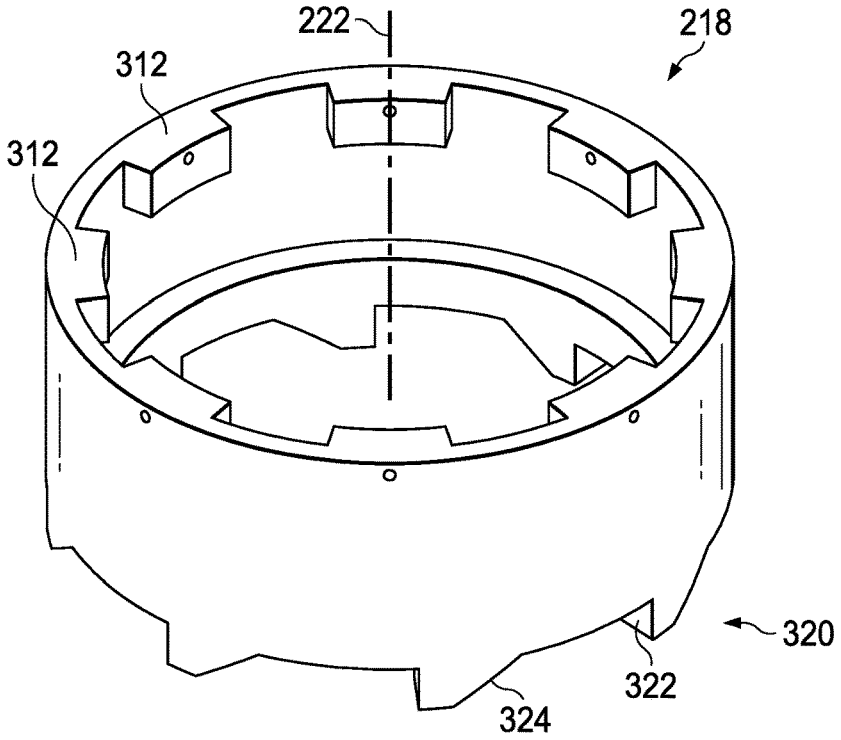
FIG. 6 is an isometric view of an embodiment of a telescoping ring, in accordance with embodiments of the present disclosure.

FIG. 6 is an isometric view of an embodiment of the telescoping ring 218 illustrating the ring lugs 312 and the lower ring transfer features 320. In this example, the ring lugs 312 as illustrated as generally rectangular and arranged circumferentially about the axis 222. As noted above, various embodiments may include more or fewer lugs, different spacing between lugs, different sizes for lugs, and the like. The lower ring transfer features 320 include the planar end 322, which engages the hanger planar end 328 when rotated in a first direction, and the sloped end 324, which engages the hanger sloped end 330 when rotated in a second direction, opposite the first direction. As noted above, in various embodiments the dimensions of the lower transfer features 320 may be particularly selected based on operating conditions.

Figure 7A:
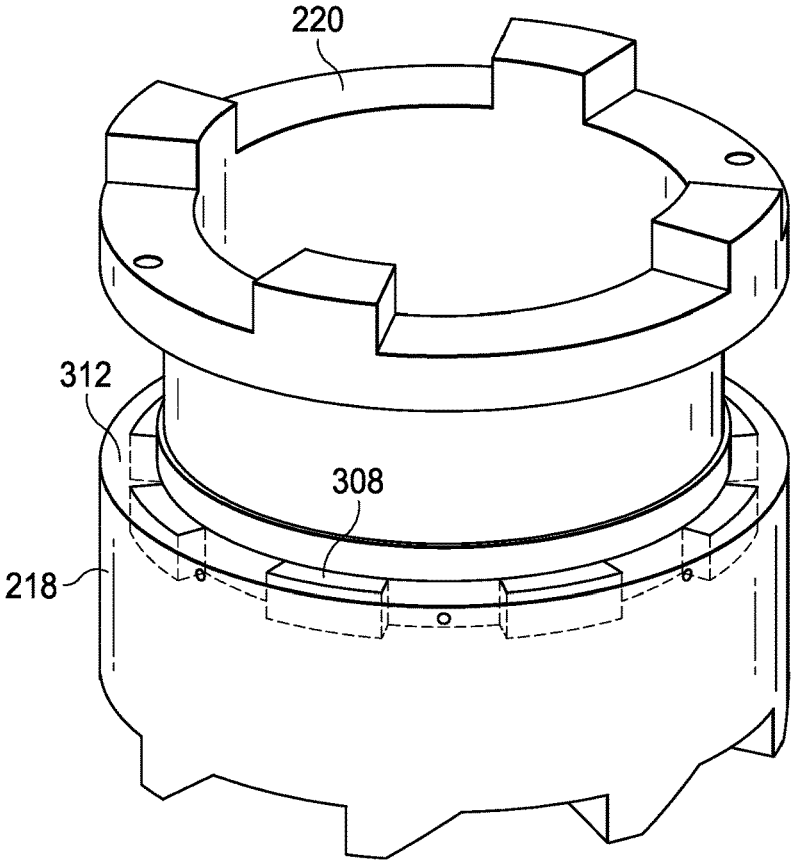
FIGS. 7A-7C are isometric views of embodiments of engagement positions between a transfer sub and a telescoping ring, in accordance with embodiments of the present disclosure.
Figure 7B:
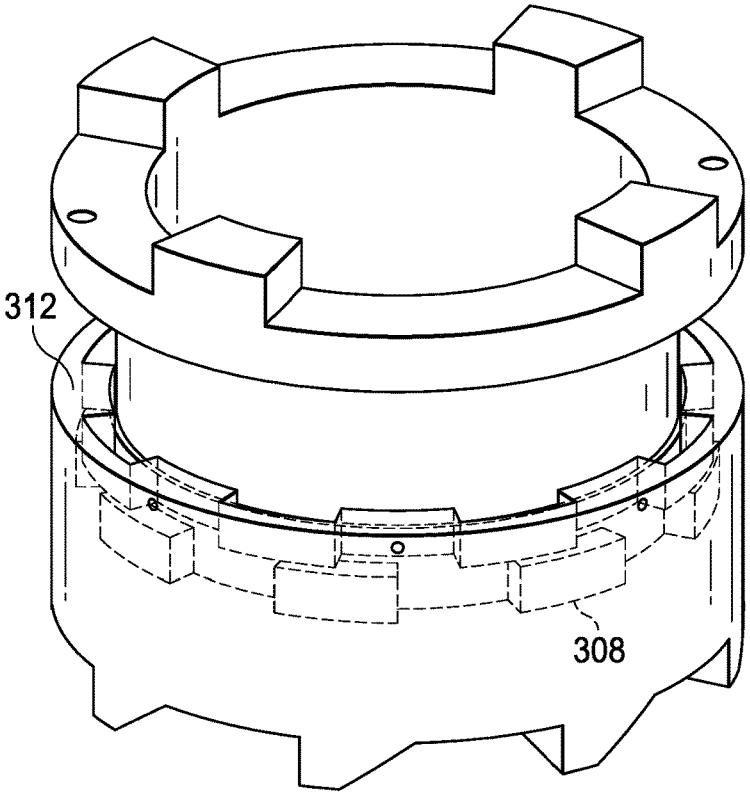
Figure 7C:
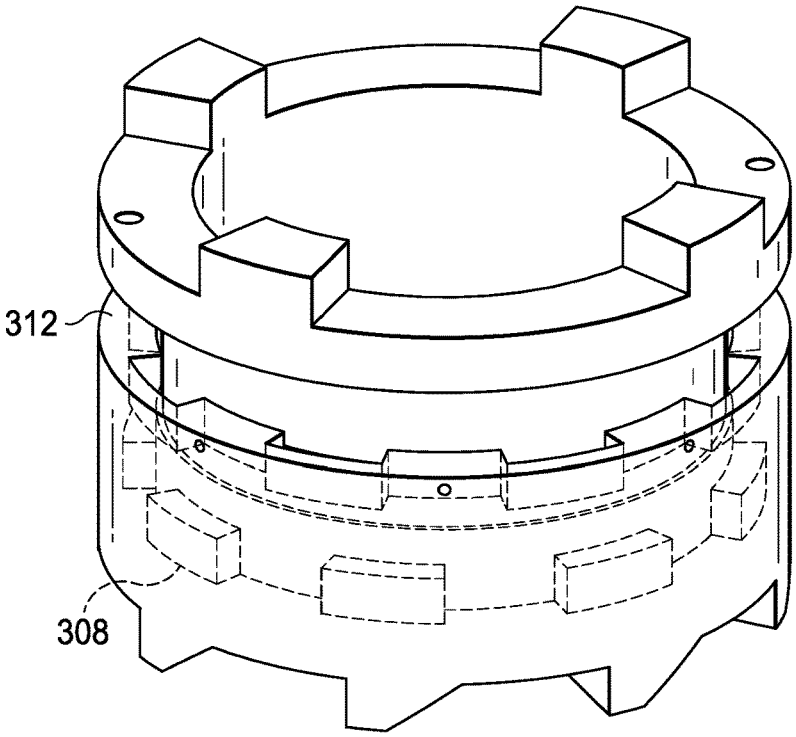

FIGS. 7A-7C illustrate isometric views of the arrangement between the telescoping ring 218 and the transfer sub 220 at an initial position (FIG. 7A), a disengaged position (FIG. 7B), and a full retracted position after locking the lock ring (FIG. 7C). Certain surfaces are shown semi-transparent for better illustration of the arrangement between the components. In these figures, the transfer sub 220 is arranged within the telescoping ring 218 and in FIG. 7A the respective lugs 308, 312 are aligned such that rotational movement of the transfer sub 220 is transmitted to the telescoping ring 218. However, in the disengaged position, the sub lugs 308 are positioned axially lower than the ring lugs 312 responsive to the upward axial movement of the telescoping ring 218. Further illustrated in FIG. 7C are the sub lugs 308 more axially lower than the ring lugs 312 when compared to FIG. 7B. This may be a result of the telescoping ring 218 being rotated enough to disengage from the casing hanger 202, for example by positioning the transfer features 320 on the shelf 402.

Figure 8A:
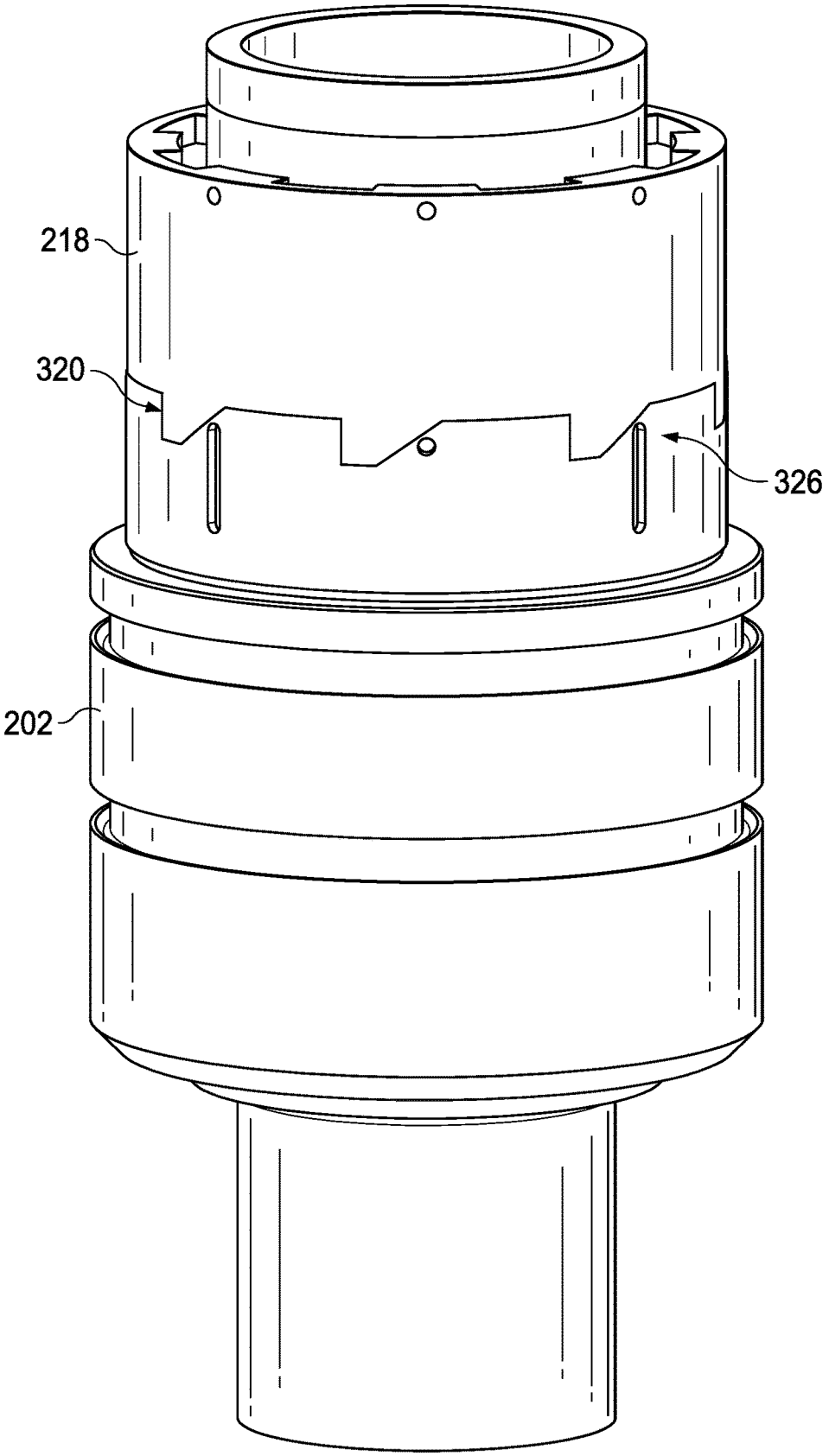
FIGS. 8A and 8B are isometric views of embodiments of engagement positions between a telescoping ring and a casing hanger, in accordance with embodiments of the present disclosure.
Figure 8B:
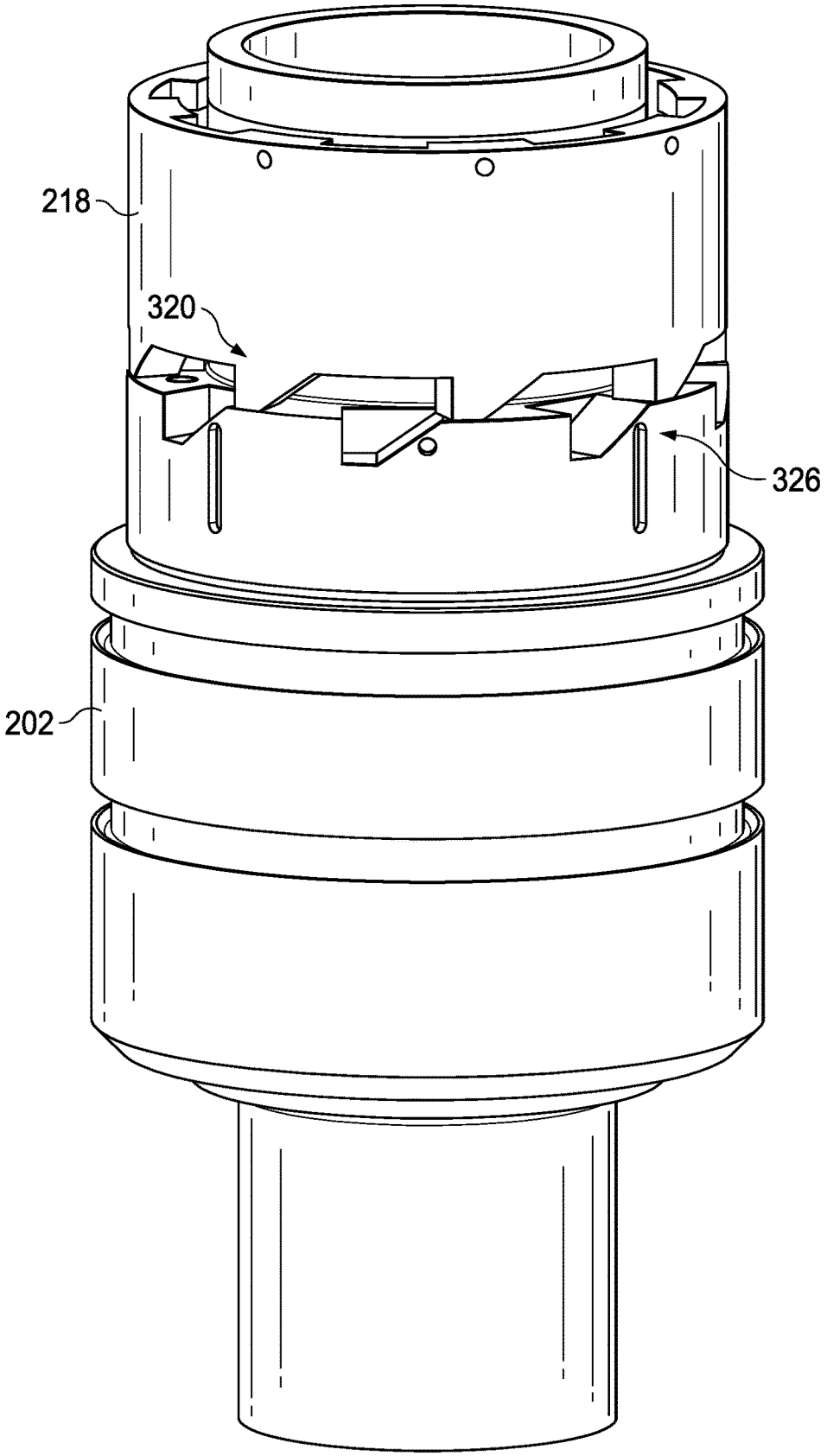

FIGS. 8A and 8B illustrate isometric views of the arrangement between the telescoping ring 218 and the casing hanger 202 at a made up position (FIG. 8A) and the initial disengaged position (FIG. 8B). As shown, in the made up position the lower ring transfer features 320 engage the hanger transfer features 326. In contrast, responsive to a rotation in the clockwise direction, FIG. 8B illustrates the lower ring transfer features 320 disengaged from the hanger transfer features 326 and positioned on the shelf 402. With respect to FIG. 8B, in various embodiments, the telescoping ring 218 remains disengaged from this point on; however, during the later stages of locking the lock ring, the telescoping ring 218 may catch or otherwise contact the casing hanger 202. As noted above, the telescoping ring 218 may be secured or otherwise maintained in this position, thereby preventing rotational forces from being transmitted from the running tool 214 to the casing hanger 202.

It should be appreciated that various embodiments disclosed herein may describe a method for utilizing the systems described herein. The method may include positioning the telescoping ring 218 onto the casing hanger 202. This may be done at an uphole location. The positioning may facilitate engagement between the features 320 and the features 326. The method may also include landing the casing hanger 202 within the wellbore. Rotational force may be applied to the running tool 214, which is transmitted to the telescoping ring 218 via the transfer sub 220, which thereby rotates the casing hanger 202 and casing coupled to the casing hanger 202. The telescoping ring 218 may also be disengaged by rotating the running tool 214 in an opposite direction, such as a counterclockwise direction, which may drive axial movement of the telescoping ring 218 in an upward direction. This upward movement may also activate one or more retaining members 400 to lock the telescoping ring 218 in place. Accordingly, further rotation of the running tool 214 may not be transmitted to the casing hanger 202 via the telescoping ring 218. The lock ring 206 may be set to secure the casing hanger 202.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A casing rotation system, comprising:

a substantially cylindrical body comprising one or more first lugs;

a telescoping ring disposed about at least a portion of the substantially cylindrical body such that it is axially movable in relation to the substantially cylindrical body, said telescoping ring comprising:

one or more second lugs configured to selectively engage with the first lugs;

a lower surface with one or more projections;

a casing hanger comprising an upper surface with one or more recesses configured to engage the one or more projections of the telescoping ring and a portion of said casing hanger disposed within the substantially cylindrical body and the telescoping ring, such that both the substantially cylindrical body and the telescoping ring are axially movable in relation to the casing hanger;

an inward-biased lock ring disposed about the casing hanger; and an energizing ring configured to move axially to a position between the lock ring and the casing hanger.

2. The casing rotation system of claim 1, wherein the one or more projections comprise a substantially planar portion and a sloped portion.

3. The casing rotation system of claim 1, wherein the substantially cylindrical body comprises a running tool coupled to the casing hanger.

4. The casing rotation system of claim 1 further comprising a running tool coupled to the casing hanger, wherein the substantially cylindrical body is disposed about the running tool.

5. The casing rotation system of claim 1, further comprising a releasable detent mechanism configured to selectively maintain the telescoping ring in a first axial position.

6. The casing rotation system of claim 1, wherein the upper surface of the casing hanger further comprises a substantially planar portion.

7. A casing rotation system, comprising:

a substantially cylindrical body comprising one or more first lugs;

a telescoping ring disposed about at least a portion of the substantially cylindrical body such that it is axially movable in relation to the substantially cylindrical body, said telescoping ring comprising:

one or more second lugs configured to selectively engage with the first lugs;

a lower surface with one or more recesses;

a casing hanger comprising an upper surface with one or more projections configured to engage the one or more recesses of the telescoping ring and a portion of said casing hanger disposed within the substantially cylindrical body and the telescoping ring, such that both the substantially cylindrical body and the telescoping ring are axially movable in relation to the casing hanger;

an inward-biased lock ring disposed about the casing hanger; and an energizing ring configured to move axially to a position between the lock ring and the casing hanger.

8. The casing rotation system of claim 7, wherein the one or more projections comprise a substantially planar portion and a sloped portion.

9. The casing rotation system of claim 7, wherein the substantially cylindrical body comprises a running tool coupled to the casing hanger.

10. The casing rotation system of claim 7 further comprising a running tool coupled to the casing hanger, wherein the substantially cylindrical body is disposed about the running tool.

11. The casing rotation system of claim 7, further comprising a releasable detent mechanism configured to selectively maintain the telescoping ring in a first axial position.

12. The casing rotation system of claim 7, wherein the lower surface of the telescoping ring further comprises a substantially planar portion.

13. A method of rotating a casing string, comprising:

coupling the casing string to a casing hanger comprising an upper end and a lower end;

coupling a running tool to the casing hanger;

axially moving a telescoping ring to a first axial position in relation to the running tool, such that one or more projections of the telescoping ring engage one or more recesses of the casing hanger;

axially moving the lower end of the casing hanger through an upper portion of a wellhead;

using the running tool, axially moving an energizing ring to a position between the casing hanger and an inward-biased lock ring, such that the lock ring radially expands to engage an inner surface of the wellhead;

rotating the running tool in a first direction.

14. The method of claim 13, further comprising the step of rotating the running tool in a second direction, such that the one or more projections disengage from the one or more recesses and the telescoping ring moves to a second axial position in relation to the running tool.

15. The method of claim 14, further comprising the step of axially moving the energizing ring to a position that is not between the casing hanger and the lock ring, such that the lock ring radially contracts to disengage the inner surface of the wellhead.

16. The method of claim 15, further comprising the step of uncoupling the running tool from the casing hanger.

17. The method of claim 13, further comprising the step of injecting cement through the casing string.

18. The method of claim 13, further comprising the step of moving the hangar to engage with a bearing at the lower end of the hangar.

19. A casing rotation system, comprising:

a substantially cylindrical body comprising one or more first lugs;

a friction reducing surface for positioning;

a telescoping ring disposed about at least a portion of the substantially cylindrical body such that it is axially movable in relation to the substantially cylindrical body, said telescoping ring comprising:

one or more second lugs configured to selectively engage with the first lugs;

a lower surface with one or more recesses;

a casing hanger comprising an upper surface with one or more projections configured to engage the one or more recesses of the telescoping ring and a portion of said casing hanger disposed within the substantially cylindrical body and the telescoping ring, such that both the substantially cylindrical body and the telescoping ring are axially movable in relation to the casing hanger;

an inward-biased lock ring disposed about the casing hanger; and an energizing ring configured to move axially to a position between the lock ring and the casing hanger.

* * * * *